United States Patent [19]

Durant et al.

[11] Patent Number: 4,460,307

[45] Date of Patent: Jul. 17, 1984

[54] REFUSE COLLECTION VEHICLE COMPACTION APPARATUS

[75] Inventors: John A. Durant, Louisville; R. Houston Ratledge, Maryville, both of Tenn.

[73] Assignee: Dempster Systems Inc., Knoxville, Tenn.

[21] Appl. No.: 404,310

[22] Filed: Aug. 2, 1982

[51] Int. Cl.[3] ..... B65F 3/04

[52] U.S. Cl. ..... 414/525 R

[58] Field of Search ..... 414/525 R

[56] References Cited

U.S. PATENT DOCUMENTS

| | | |
|---|---|---|
| 3,143,230 | 5/1960 | Gollnick . |
| 3,348,708 | 7/1965 | Gollnick . |
| 3,402,837 | 9/1968 | Palmer et al. . |
| 3,556,324 | 1/1971 | McCarthy . |
| 3,615,028 | 10/1971 | Appleman et al. . |
| 3,696,951 | 10/1972 | Toppins et al. . |
| 3,786,946 | 1/1974 | Toppins et al. . |
| 3,999,669 | 12/1976 | Smith ..... 414/525 R X |
| 4,029,224 | 6/1977 | Herpich et al. ..... 414/525 R |
| 4,316,695 | 2/1982 | Knight . |

*Primary Examiner*—Joseph E. Valenza
*Assistant Examiner*—David A. Bucci
*Attorney, Agent, or Firm*—Jacox & Meckstroth

[57] ABSTRACT

Compaction apparatus for a refuse collection vehicle provided with a body having a hopper to receive refuse. The hopper has opposed enclosure side walls. Hydraulic motor members are positioned adjacent the enclosure side walls and operate a packer member which extends between the enclosure side walls and which forces refuse from the hopper into another portion of the body for compaction of the refuse. The hydraulic motor members are thus positioned so that a maximum opening into the hopper is provided for receiving the refuse and for compaction thereof, and the packer member is of maximum length between the side walls to compact a maximum volume of refuse in the body during each compaction cycle.

5 Claims, 6 Drawing Figures

REFUSE COLLECTION VEHICLE COMPACTION APPARATUS

BACKGROUND OF THE INVENTION

A refuse collection vehicle has a body for containing refuse and a hopper at the rear portion of the body. The body has an opening at the rear end thereof leading to the hopper. Operable within the hopper is a refuse compaction apparatus which compacts the refuse and urges the refuse forwardly within the body.

The hopper of a refuse collection vehicle is adapted to receive refuse containers of various sizes which are supported by a person who dumps the container into the hopper. A refuse collection vehicle is also adapted to receive a relatively large refuse container which is supported by a machine and dumped into the hopper. Such a large refuse container has a portion which is positioned within the opening at the rear of the refuse collection vehicle as the refuse from the container is dumped into the hopper of the refuse collection vehicle.

It is an object of this invention to provide refuse compaction apparatus which is capable of exerting greater forces for refuse compaction than other mechanism having comparable power capacity for such compaction.

It is another object of this invention to provide such compaction apparatus which provides a greater opening for receiving refuse and for receiving refuse containers than other refuse collection bodies of comparable physical size.

It is another object of this invention to provide such compaction apparatus which as a packer member of maximum area for compaction of a maximum volume of refuse during each compaction cycle.

Other objects and advantages of this invention reside in the construction of parts, the combination thereof, the method of production, and the mode of operation, as will become more apparent from the following description.

DETAILED DESCRIPTION OF THE INVENTION

Figure 1:
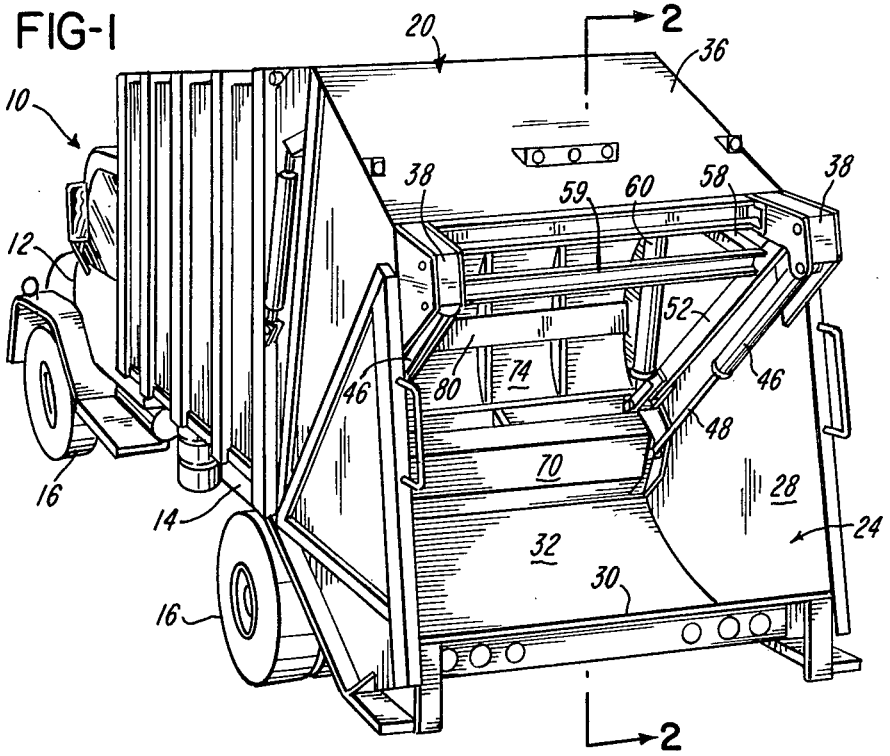
FIG. 1 is a rear perspective view of a refuse collection vehicle provided with refuse compaction apparatus of this invention.

FIG. 1 shows a refuse collection vehicle 10 which includes a cab 12, frame 14, and wheels 16. Mounted upon the frame 14 is a refuse retainer body 20. The rear portion of the body 20 is open. Within the open end of the body 20 is a hopper 24, provided with side walls 28, a floor portion 30 and a floor portion 32. The rear portion of the body 20 also has a roof 36.

Operable within the hopper 24 is compaction apparatus of this invention. Attached to the roof 36 and side walls 28 of the body 20 at the rear portion thereof and extending therefrom are brackets 38. Attached within the body 20, adjacent the roof 36, and adjacent each side wall 28 is a bracket 42.

Pivotally attached to each bracket 38 is a hydraulic motor 46 provided with a reciprocally movable actuator rod 48. Also pivotally attached to each bracket 38 is a rigid arm 52. Each rigid arm 52 is positioned directly above its respective hydraulic motor 46. Rigidly attached to each rigid arm 52 and extending angularly therefrom is a rigid connector bar 58. Joining the rigid arms 52 together is an elongate substantially horizontal rigid cross member 59.

Pivotally attached to each bracket 42 and extending downwardly therefrom is a hydraulic motor 60 provided with a reciprocally movable actuator rod 62. Pivotally attached to the end of the actuator rods 62 and pivotally attached to the end of the rigid arms 52 is a packer plate 70. The actuator rod 48 of the hydraulic motor 46 is also pivotally attached to the packer plate 70.

The rigid connector bars 58 are secured to a shield 74, at opposite ends thereof. Each rigid arm 52 has a link 78 attached thereto which is also attached to the shield 74, at each end thereof. The shield 74 has a horizontally disposed brace member 80 extending thereacross.

An interior wall member 86 is attached to the interior of the upper portion of the body 20 and extends downwardly therefrom to a position spaced from the floor portion 32. Thus, an opening is provided between the interior wall member 86 and the floor portion 32.

Operation

Figure 2:
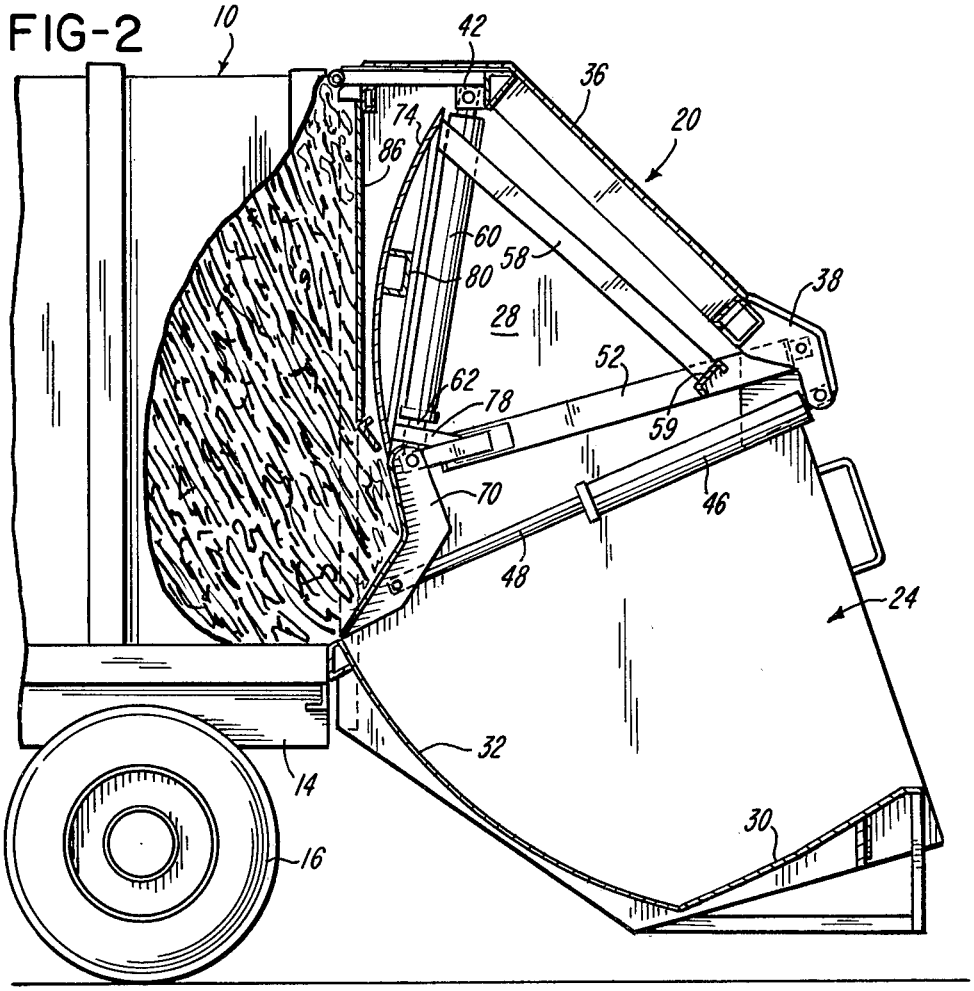
FIG. 2 is a sectional view taken substantially on line 2—2 of FIG. 1, and drawn on a larger scale than FIG. 1, illustrating the refuse compaction apparatus in one position of operation.
Figure 3:
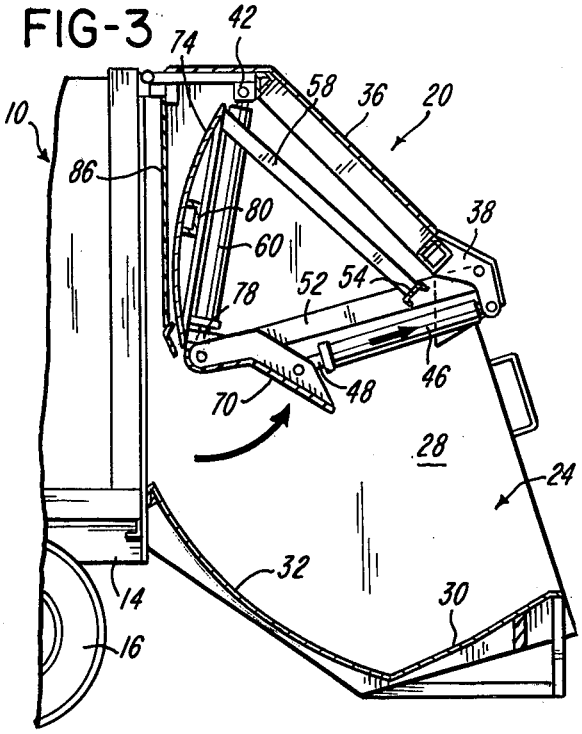
FIG. 3 is a side view with parts shown in section and drawn on a smaller scale than FIG. 2, illustrating the refuse compaction apparatus of this invention in another position of operation.
Figure 4:
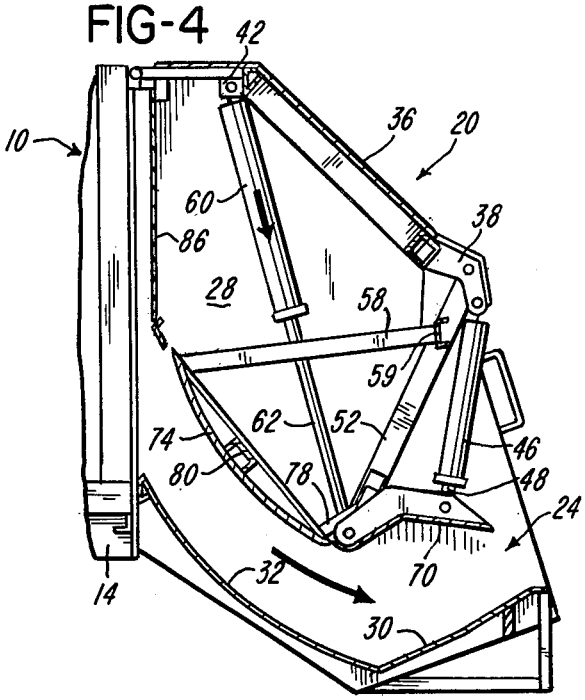
FIG. 4 is a side view, with parts shown in section, similar to FIG. 3 and illustrating the refuse compaction apparatus in another position of operation.
Figure 5:
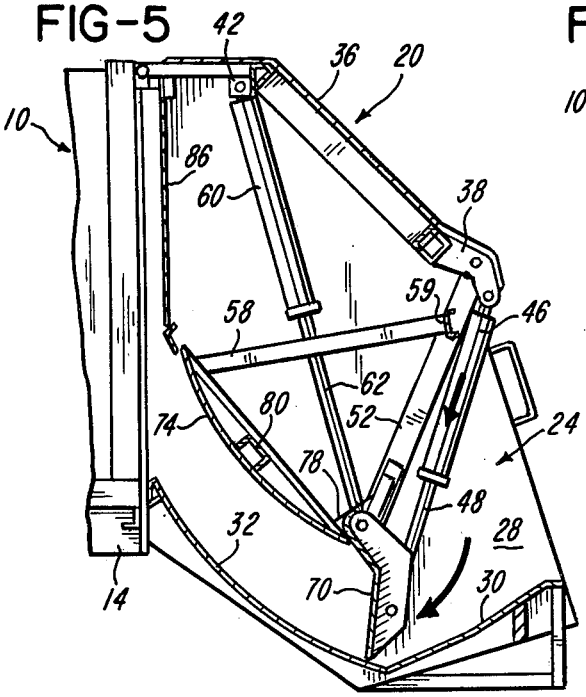
FIG. 5 is a side view, with parts shown in section, similar to FIGS. 3 and 4, and showing the refuse compaction apparatus in another position of operation.
Figure 6:
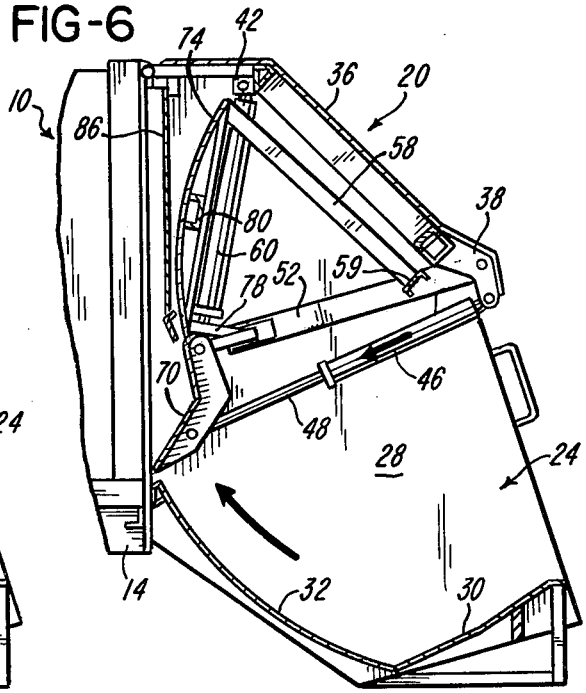
FIG. 6 is a side view, with parts shown in section, similar to FIGS. 3, 4, and 5, showing the compaction apparatus in another position of operation.

FIG. 3 illustrates the position of the members of the compaction apparatus of this invention prior to the start of a compaction cycle. Prior to commencement of a compaction cycle, refuse is deposited in the hopper 24 and upon the floor portions 30 and 32. After a significant load of refuse has been deposited in the hopper 24 and upon the floor portions 30 and 32 a compaction cycle is started. Control means, not shown, causes fluid to be forced into the hydraulic motors 60, and the actuator rods 62 thereof force the shield 74 and the packer plate 70 downwardly, as illustrated in FIG. 4. When this position is assumed, the shield 74 is at an angle and spaced above the floor portion 32 and providing a barrier against improper movement of refuse. Then fluid is forced into the hydraulic motors 46, and the actuator rods 48 thereof force the lower portion of the packer plate 70 downwardly toward the floor portions 30 and 32, as illustrated in FIG. 5. As this action occurs, the hydraulic motors 60 retract the actuator rods 62, and the shield 74 and the packer plate 70 move upwardly, as the packer plate 70 travels along the floor portion 32 and forces refuse into the opening between the interior wall member 86 and the floor portion 32, as illustrated in FIGS. 2 and 6. Thus, refuse from the hopper 24 is packed into the body 20.

It is to be observed that the hydraulic motors 46 and 60 and the rigid arms 52 which are adjacent each side wall 28 are in substantially the same plane. Therefore the effective width of the hopper 24 is a maximum for receiving refuse deposited therein by hand supported containers. Also the effective width of the hopper 24 is a maximum for receiving a machine supported large container of refuse for dumping thereof into the hopper 24. The effective maximum width of the hopper 24 also provides space to receive a shield 74 and packer plate 70 of maximum width between the side walls 28 for compaction of the maximum volume of refuse upon each compaction operation. Also, due to the fact that the hydraulic motors 46 and 60 and the rigid arms 52 adjacent each side wall 28 are always in the same plane during operation thereof, the magnitude of forces exerted for compaction are greater than the forces available in other compaction mechanisms of the same physical size which have different arrangements in the elements of the compaction mechanism.

Although the preferred embodiment of the refuse collection vehicle compaction apparatus of this invention has been described, it will be understood that within the purview of this invention various changes may be made in the form, details, proportion and arrangement of parts, the combination thereof, and the mode of operation, which generally stated consist in refuse compaction operation within the scope of the appended claims.

The invention having thus been described, the following is claimed:

1. In a refuse collection vehicle including a wheel-supported body for receiving and containing refuse, said body including opposite side walls connected by a floor and a roof to define a forward refuse storage chamber and a rearward loading hopper separated from the storage chamber by an intermediate wall, the intermediate wall having a lower edge cooperating with the floor to define an opening connecting the hopper to the storage chamber, a shield extending between the side walls of the hopper and supported by a pair of arms for oscillatory movement between an upper position adjacent the intermediate wall and a lower position spaced above the floor of the hopper, a packing plate extending between the side walls of the hopper and pivotally connected to a lower portion of the shield, means including a pair of upper hydraulic actuating cylinders connected to oscillate the shield, and means including a pair of lower hydraulic actuating cylinders connected to pivot the packing plate relative to the shield, the improvement comprising a pair of brackets secured to the side walls of the hopper, each said bracket supporting an upper pivot member and a lower pivot member disposed in vertically spaced relation, the upper pivot members on the brackets pivotally supporting the arms which support the shield to provide for the oscillatory movement of the shield, the lower pivot members on the brackets supporting the pair of lower hydraulic actuating cylinders for pivotal movement when actuated to pivot the packing plate, the lower pair of hydraulic actuating cylinders being disposed directly under the corresponding pair of arms, and the lower pair of hydraulic actuating cylinders, the arms and the packing plate having pivot axes forming the corners of a quadrilateral figure.

2. A refuse collection vehicle as defined in claim 1 wherein the packing plate is supported by upper pivot members and lower pivot members defining upper and lower pivot axes, and the spacing between the upper and lower pivot members supporting the packing plate is greater than the spacing between the upper and lower pivot members supported by the brackets to produce relative pivotal movement between the shield and the packing plate in response to actuation of the upper hydraulic actuating cylinders.

3. A refuse collection vehicle as defined in claim 1 wherein the pair of upper hydraulic actuating cylinders, the pair of arms and the pair of lower hydraulic actuating cylinders are disposed in corresponding parallel spaced planes disposed adjacent the side walls defining the loading hopper.

4. In a refuse collection vehicle including a wheel-supported body for receiving and containing refuse, said body including opposite side walls connected by a floor and a roof to define a forward refuse storage chamber and a rearward loading hopper separated from the storage chamber by an intermediate wall, the intermediate wall having a lower edge cooperating with the floor to define an opening connecting the hopper to the storage chamber, a shield extending between the side walls of the hopper and supported by a pair of arms for oscillatory movement between an upper position adjacent the intermediate wall and a lower position spaced above the floor of the hopper, a packing plate extending between the side walls of the hopper and pivotally connected to a lower portion of the shield, means including a pair of upper hydraulic actuating cylinders connected to oscillate the shield, and means including a pair of lower hydraulic actuating cylinders connected to pivot the packing plate relative to the shield, the improvement comprising a pair of brackets secured to the side walls of the hopper, each said bracket supporting an upper pivot member and a lower pivot member disposed in vertically spaced relation, the upper pivot members on the brackets pivotally supporting the arms which support the shield to provide for the oscillatory movement of the shield, the lower pivot members on the brackets supporting the pair of lower hydraulic actuating cylinders for pivotal movement when actuated to pivot the packing plate, the packing plate having an upper portion and a lower portion defining an obtuse angle therebetween in vertical cross-section, the lower pair of hydraulic actuating cylinders being disposed directly under the corresponding pair of arms, the lower pair of hydraulic actuating cylinders, the arms and the packing plate having pivot axes forming the corners of a quadrilateral figure, and the spacing between the pivot axes on the packing plate being greater than the spacing of the pivot axes on the brackets to effect predetermined pivotal movement of the packing plate relative to the shield and to produce a shearing action of the refuse between the shield and the hopper floor in response to actuation of the upper hydraulic actuating cylinders.

5. A refuse collection vehicle as defined in claim 4 wherein the pair of upper hydraulic actuating cylinders, the pair of arms and the pair of lower hydraulic actuating cylinders are disposed in corresponding parallel spaced planes disposed adjacent the side walls defining the loading hopper.

* * * * *